US005343115A

United States Patent [19]

Anandan et al.

[11] Patent Number: 5,343,115

[45] Date of Patent: Aug. 30, 1994

[54] EFFICIENT LARGE AREA MULTI-CHANNEL FLAT FLUORESCENT LAMP

[75] Inventors: Munisamy Anandan, Wayne; Douglas Ketchum, Rockaway, both of N.J.

[73] Assignee: Thomas Electronics Incorporated, Wayne, N.J.

[21] Appl. No.: 883,183

[22] Filed: May 15, 1992

[51] Int. Cl.[5] ..... H01J 63/02

[52] U.S. Cl. ..... 313/491; 313/493; 313/618; 313/631; 313/331; 313/292; 313/581; 313/586; 345/43; 345/45; 315/169.4

[58] Field of Search ..... 313/491, 493, 581, 583, 313/584, 586, 631, 634, 331, 618, 292; 340/781, 784; 315/169.3, 169.4, 58; 345/43, 45

[56] References Cited

U.S. PATENT DOCUMENTS

| | | | |
|---|---|---|---|
| 3,894,264 | 7/1975 | Andoh et al. | 313/586 X |
| 3,931,537 | 1/1976 | Nishida et al. | 313/583 |
| 3,952,221 | 4/1976 | Kamegaya et al. | 313/491 X |
| 4,978,888 | 12/1990 | Anandan et al. | 313/493 X |

OTHER PUBLICATIONS

Hathaway, Hawthorne, Fleischer, "New Backlighting Technologies for LCDs", Society for Information Display, International Symposium, Digest of Technical Papers, vol. XXII, pp. 751–754, May 6, 1991.

Hinotani, Kishimoto, Terada, "Flat Fluorescent Lamp for LCD Backlight," International Display Research Conference, pp. 52–55, 1988.

*Primary Examiner*—Donald J. Yusko
*Assistant Examiner*—Ashok Patel
*Attorney, Agent, or Firm*—Davis Hoxie Faithfull & Hapgood

[57] ABSTRACT

A large area multi-channel flat fluorescent lamp with improved efficiency consists of two groups of closed hollow electrodes which are printed on the inner surfaces of the opposing ends of two flat glass substrates. The substrates are sealed together and have wave-guiding spacers which protect the lamp from implosion and also maintain a fixed spacing between the two substrates. A dielectric reflective layer is coated on the inner side of one of the substrates with an over-coat of phosphor, and the inner opposing surface of the other substrate is coated with only the phosphor. The space between the substrates is first evacuated and then filled with an inert gas and mercury vapor. The multi-channel closed hollow electrode structure with wave-guiding spacers, in combination with a reflective dielectric layer produces greater brightness with better brightness uniformity over a large area. In addition, the large area multi-channel flat fluorescent lamp maintains high efficiency and has a long life.

28 Claims, 7 Drawing Sheets

EFFICIENT LARGE AREA MULTI-CHANNEL FLAT FLUORESCENT LAMP

BACKGROUND OF THE INVENTION

1. Field of Invention

The present invention relates to a method of manufacture and apparatus for an improved efficiency large area flat fluorescent lamp. More particularly, the present invention utilizes waveguiding spacers, closed hollow electrodes and an internal dielectric mirror to achieve improved brightness, greater uniformity of brightness and longer life.

2. Description of the Prior Art

The technology of small portable video screens is continuously improving. Bulky cathode ray tube screens are increasingly being replaced by low weight flat screens. One popular video screen utilizes liquid crystal display technology. Most liquid crystal displays used in computer terminals, portable televisions and video phones depend on a backlighting source to display high quality information and images. Prior art backlighting sources employ various designs in which the primary source of light is from conventional tubular fluorescent lamps.

Both as an improvement over the tubular fluorescent backlight design and to meet the size and thickness requirements of liquid crystal displays, the need for a flat fluorescent lamp backlight design arose. One prior art technique uses two electrodes on opposite ends of a flat fluorescent lamp. See K. Hinotani, S. Kishimoto, K. Terada, "Flat Fluorescent Lamp for LCD Backlight", International Display Research Conference 52–55, 1988. This design employs a single discharge channel consisting of two discrete hollow electrodes running the entire length of each side of the lamp.

Although the Hinotani et al. design represents an improvement over the tubular fluorescent lamp backlight design, the problems of substantial light loss and non-uniformity of brightness are still present. Light loss in the Hinotani et al. backlight can be attributed to several factors including the use of substrate spacers that are inefficient light waveguides. Further loss of light can be attributed to absorption of visible light by the rear substrate glass. This loss of light occurs because the aluminum reflecting film is disposed on the external surface of the rear substrate. A portion of the generated light is absorbed by the rear substrate as the light travels through the rear substrate to the reflecting film.

Another improved backlight design proposed for liquid crystal displays is disclosed in Hathaway, Hawthorne, Fleisher, "New Backlighting Technologies for LCDs", Society for Information Display, International Symposium, Digest of Technical papers, Vol. XXII, pages 751–754, May 6–10, 1991. The Hathaway et al. backlight is a flattened tubular fluorescent lamp that has been bent at several points to form a serpentine-like tube structure. A problem with this design is the substantial non-uniformity of brightness. Shadow effects or light discontinuities exist at each barrier between adjacent arms of the serpentine-like tube structure which produce non-uniform brightness. The brightness uniformity of the Hathaway et al. backlight is less than that for the Hinotani et al. design. Further, the Hathaway et al. backlight utilizes a larger and more cumbersome structure of discrete components apparently without the possibility of integrated construction.

SUMMARY OF THE INVENTION

According to the present invention, two groups of thick-film conductors comprised of two different materials are printed on the inner surfaces of a pair of substrates. The groups are disposed on opposite sides of the substrate. Conductors in a group are electrically isolated from each other by dielectric isolators placed at the gaps between adjacent conductors. Light waveguiding spacers are disposed between the substrates at fixed locations in the central illumination area. The internal surfaces of the substrates are each coated with a layer of phosphor. A dielectric reflective layer is deposited beneath the phosphor layer on the rear substrate. The substrates are then sealed together. Finally, the air in the space between the substrates is evacuated and the space is filled with inert gas and mercury vapor, resulting in the internal pressure of the lamp being considerably less than atmospheric pressure.

When a suitable amplitude and frequency of electrical potential are applied to the electrodes, the inert gas and mercury vapor will pass an electric current causing the mercury to give off ultraviolet rays (253.7 nm and 185 nm). The ultraviolet rays cause excitation of the phosphor coating which produces the emission of visible light from the flat fluorescent lamp. The seal further preserves the purity of the contents of the flat fluorescent lamp.

It is an object of the present invention to provide a flat fluorescent lamp with an improved electrode design. The improved design is readily manufacturable and will have greater brightness uniformity and superior brightness.

A further object of the invention is to make the lamp with reduced visible and ultra-violet light losses by having a dielectric reflective layer on the inner surface of the rear glass substrate.

Yet another object of the invention is to provide the lamp with light wave-guiding spacers to facilitate the use of thin substrates for large area lamps while minimizing brightness dip at the spacer sites. In addition, the spacers support the lamp structure and prevent the implosion that could result because of the difference between the internal and external pressures of the flat fluorescent lamp.

A further object of the invention is to provide an alternative method of manufacture of the lamp and a lamp apparatus which utilizes integral light wave-guiding spacers on one of the lamp substrates.

A further object of the invention is to provide a planar ultra-violet lamp useful as a light source in the process of photolithography.

DETAILED DESCRIPTION

Figure 1:
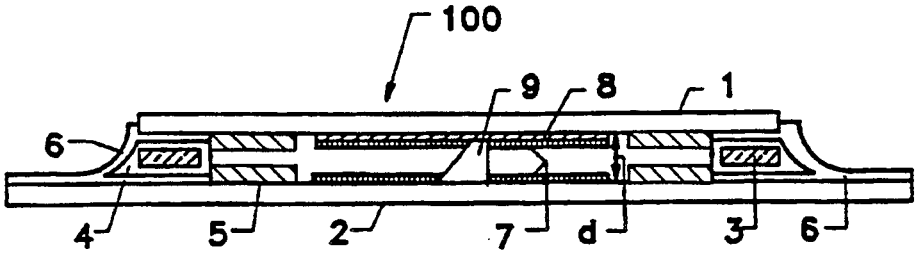
FIG 1 is a sectional elevational view of an arrangement, omitting evacuation tubing and dielectric isolators for clarity, of an efficient large area multichannel thick-film integrated flat fluorescent lamp in accordance with the present invention.

FIG. 1 shows, in cross-section, the overall construction of a fully assembled flat fluorescent lamp 100 according to the present invention. The present invention is related to the thick-film integrated flat fluorescent lamp disclosed in U.S. Pat. No. 4,978,888, assigned to the assignee of the present application, which issued Dec. 18, 1990 and is incorporated by reference herein. In FIG. 1, assembled lamp 100 has a flat rear substrate 1 and a flat front substrate 2. As shown, substrate 1 is above substrate 2, however, it should be understood that in a typical use, the lamp 100 will be oriented such that substrate 2 is the substrate from which light will emanate. Consequently, the inner surface of the rear substrate 1 is coated with a reflective layer 8. The reflective layer 8 increases the lamp's efficiency by increasing the amount of light emanating from the front substrate 2.

Figure 8:
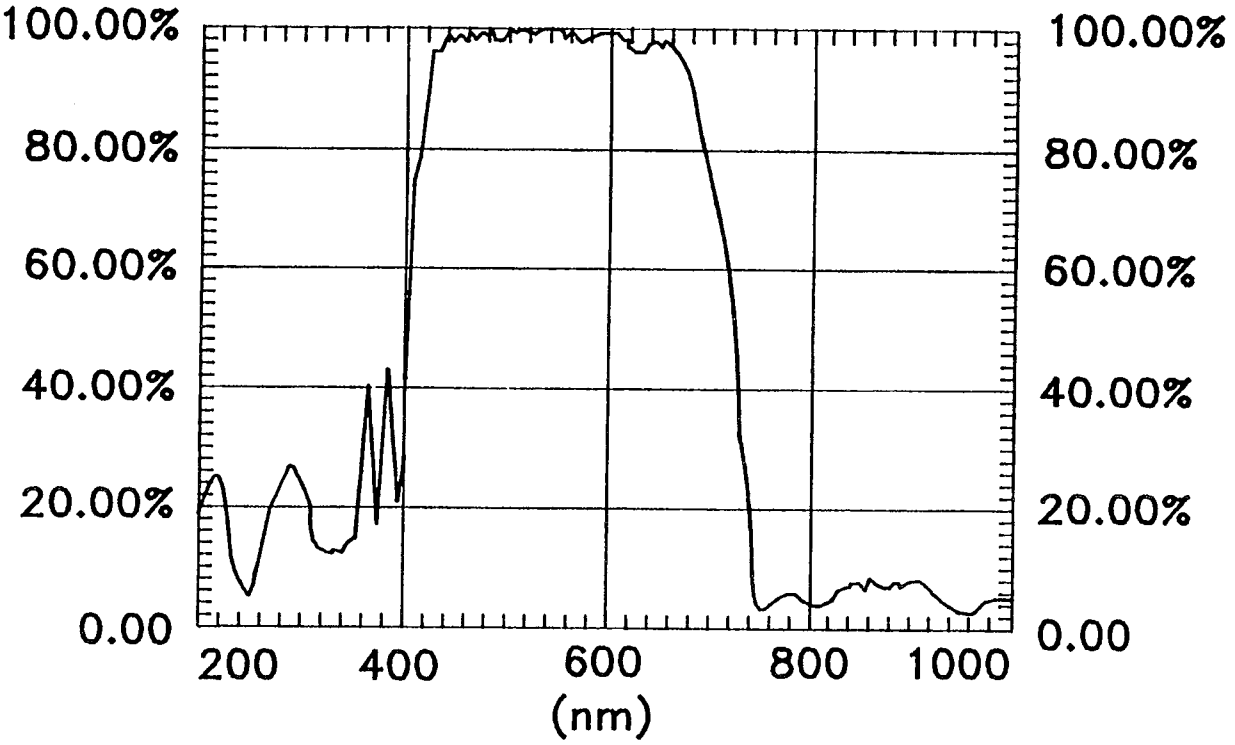
FIG. 8 is a chart of the spectral reflectance of a typical thin-film multilayer dielectric suitable for the mirror shown in FIGS. 1-3, 6 and 7.

The reflective layer 8 could be a thick-film or a thin-film multi-layer and should preferably have a reflectance greater than 90% in the visible light range, and should have reflectance in the ultra-violet light range. Examples of preferred thin-film multi-layer combinations exhibiting these properties include titanium dioxide and silicon dioxide, zirconium dioxide and silicon dioxide, or hafnium dioxide and silicon dioxide. A typical spectral reflectance chart for a suitable thin-film multi-layer reflector of titanium dioxide and silicon dioxide is depicted in FIG. 8. Examples of single layer thick-film reflective materials are titanium dioxide or magnesium dioxide.

Figure 2:
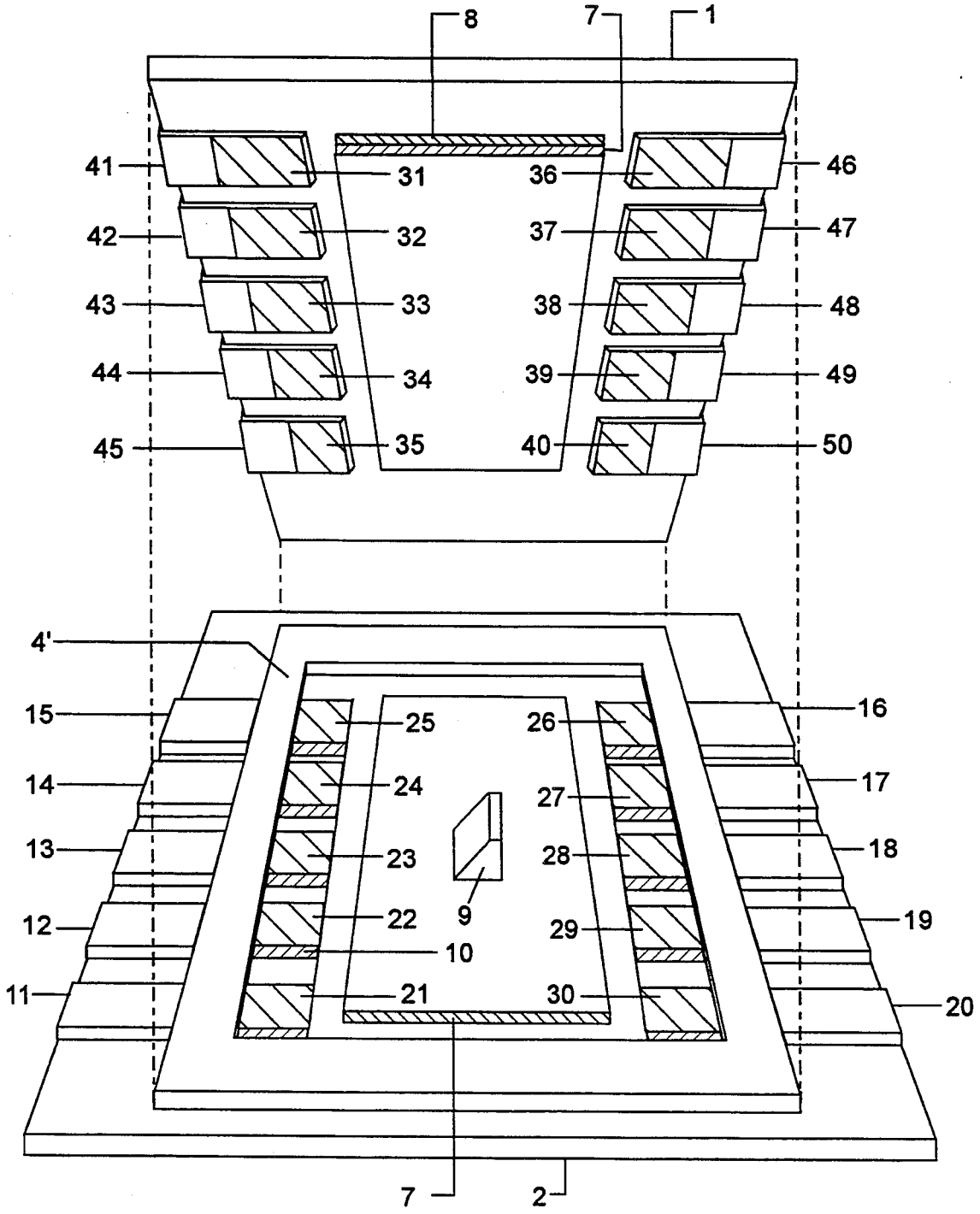
FIG. 2 is a view of the arrangement shown in FIG. 1 prior to completion of assembly, and again omitting the evacuation tubing for clarity.

The rear substrate 1 and front substrate 2 are separated by a distance d. A plurality of dielectric isolators 10 (seen in FIG. 2) and a dielectric seal 4 (seen in FIG. 2) maintain the appropriate separation between the substrates 1 and 2. The dielectric seal 4 comprises a seal spacer frame 3 surrounded by dielectric seal material. As seen in FIG. 2, a central illumination area is defined and bounded by the dielectric seal 4 which is inset from the substrate edges and extends along the perimeter of the substrates. Upon assembly, the dielectric seal 4 in conjunction with a thick-film of silver 6 form a vacuum tight seal between the front substrates 2 and the rear substrates 1.

In FIG. 2, the components of lamp 100 are shown prior to completion of assembly to better illustrate the configuration and alignment of various elements of the lamp 100. FIG. 2 illustrates a plurality of main discharge electrodes comprising thick-film nickel conductors 21 to 30 on front substrate 2, and thick-film nickel conductors 31 to 40 on rear substrate 1. These conductors are arranged into two groups of five on each substrate, each group being disposed symmetrically on the left and right side of substrate 1 and substrate 2. The number of discharge electrodes can be more or less than that shown in FIGS. 2 and 3 depending upon the size of the lamp and the intended application.

Upon assembly, electrode conductor 21 is aligned to face and oppose conductor 31. In the same manner, the sequence of electrode conductors 22–30 face and oppose electrode conductors 32–40, respectively. Each conductor of the plurality of thick-film nickel electrode conductors 21–30 of substrate 2 is electrically connected under the dielectric seal 4 to a corresponding thick-film silver lead-through conductor 11–20, respectively. Similarly, each of the plurality of electrode conductors 31–40 of substrate 1 is electrically connected to a thick-film silver lead-through conductor 41–50, respectively.

The lamp 100 also includes a right angle prism support spacer 9 (also shown in FIG. 5) which helps prevent substrates 1 and 2 from imploding under atmospheric pressure. Implosion may occur after assembly because the internal portion of the lamp is at a pressure considerably lower than atmospheric pressure. The right angle prism 9 has an additional special feature, described in detail below, to minimize the shadow-effect due to its presence during operation of the lamp 100.

The lamp 100 further includes a thick-film phosphor layer 7 on each of the substrates 1 and 2. The phosphor layer 7 on the rear substrate 1 is preferably deposited on top of the reflective layer 8.

A preferred method of construction of lamp 100 is described below. First, a thin film of multi-layer dielectric mirror 8 is vacuum coated on substrate 1. Next, a thick-film of silver is printed on the substrates 1 and 2 to form leads through conductors 11–20 and 41–50. This thick-film of silver is dried at 90° C. for 45 minutes. Next, a thick-film of nickel is printed on substrates 1 and 2, which overlaps a narrow area of the silver lead-through conductors and forms the discharge electrodes 21–30 and 31–40. This thick-film of nickel is also dried at 90° C. for 45 minutes. Next, the phosphor layer 7 is either printed or sprayed on substrates 1 and 2 with the lead-through conductors, nickel conductors and locations for light wave-guiding spacers being masked. The masking prevents any phosphor from being deposited in the masked areas. The phosphor layer 7 is then dried at 90° C. for 18 minutes. Substrates 1 and 2 containing the layers of silver, nickel and phosphor are then heat-treated at 580° C. for 18 minutes.

A seal spacer frame, such as the seal spacer frame 3 of FIG. 1, is then coated with glass-frit to form a glass-frit coated seal frame 4'. Glass-frit is a paste which when heated will fuse pieces of glass together. The glass-frit coated seal frame 4' and a plurality of dielectric isolators 10 are then laid on the substrate 2. The glass-frit coated seal frame 4' will form the dielectric seal 4 of FIG. 1 upon completion of the assembly process.

The prism 9 is affixed with glass-frit in a region on substrates 2 where phosphor has either been removed or left clear by masking during the phosphor deposition process described above. A glass-frit coated evacuation tube (not shown in the Figures) is laid on substrate 1 at the half-section of an evacuation hole. Substrates 1 and 2 with the above assembled members are then pre-glazed at 450° C. for 18 minutes.

Finally, substrates 1 and 2 are placed in alignment and sealed together. Sealing occurs by heating the pre-glazed glass-frit layers on the seal frame 3 at 522° C. for 72 minutes. While the assembly is being heated, a compression force is applied by placing a massive sealing block over the assembled substrates to press the substrates together.

Next, silver paste is painted over the flown glass-frit to externally electrically connect each of the plurality of silver lead-through conductors 41–50 on substrate 1 to the corresponding one of the plurality of silver lead-through conductors 11–20 on substrate 2. These electrical connections are made such that electrical isolation between each of the conductor pairs is preserved.

The completed lamp 100 has a cross-section approximately as shown in FIG. 1. The interior cavity of lamp 100 is evacuated through an evacuation tube with a bake-out temperature of 400° C. for 3 hours. The heating of the lamp during the evacuation process will assist in removing all remaining gases from the interior cavity of the lamp. The cavity is then filled with mercury and inert gas at a pre-determined low pressure, such as a pressure of less than 100 torr. Then the evacuation tube is sealed off. The resulting internal cavity pressure is considerably less than atmospheric pressure outside the lamp.

Figure 3:
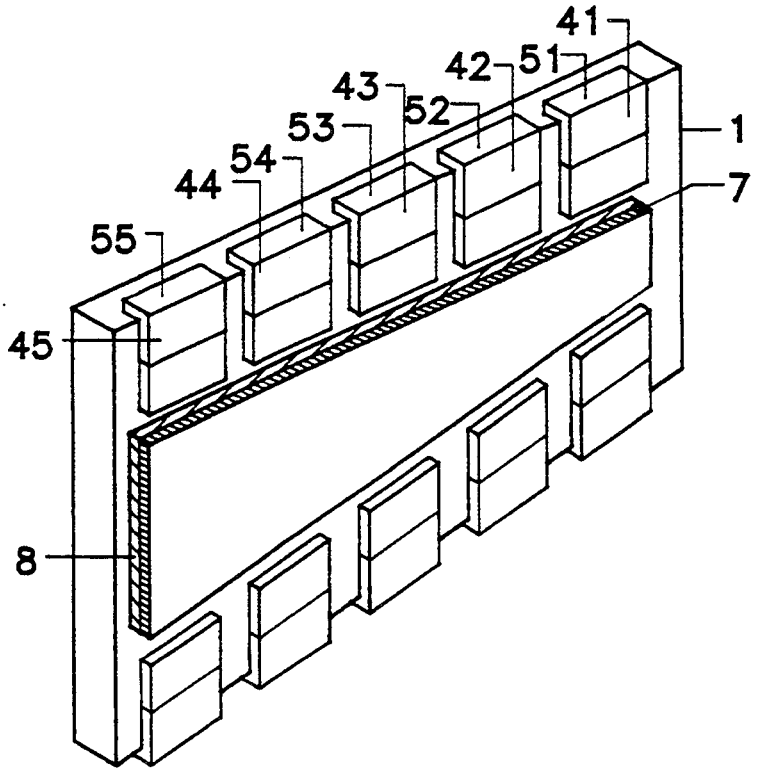
FIG. 3 is an end and side view of the inside surface of the rear substrate shown in FIGS. 1 and 2.

FIG. 3 illustrates that the silver lead-through conductors 41–45 of rear substrate 1 have extended portions 51–55 which wrap around the edge of substrate 1. These extended portions 51–55 and the corresponding portions for conductors 46–50 (not shown in FIG. 3) facilitate the electrical connection of lead-through conductors 41–50 of substrate 1 to the lead-through conductors 11–20 or substrate 2. With the substrates sealed together these exposed extended portions permit ease of manufacture of the electrical connections between the respective lead-through conductors of the two substrates. The electrical connections between respective lead-through conductors can be made by simply painting the gap between the conductor pairs at the substrate edge with silver paste. These electrical connections effectively connect each of the electrode conductors 21–30 of substrate 2 to the respective electrode conductors 31–40 of substrate 1. These conductor connections are collectively illustrated as area 6 in FIG. 1.

Figure 4:
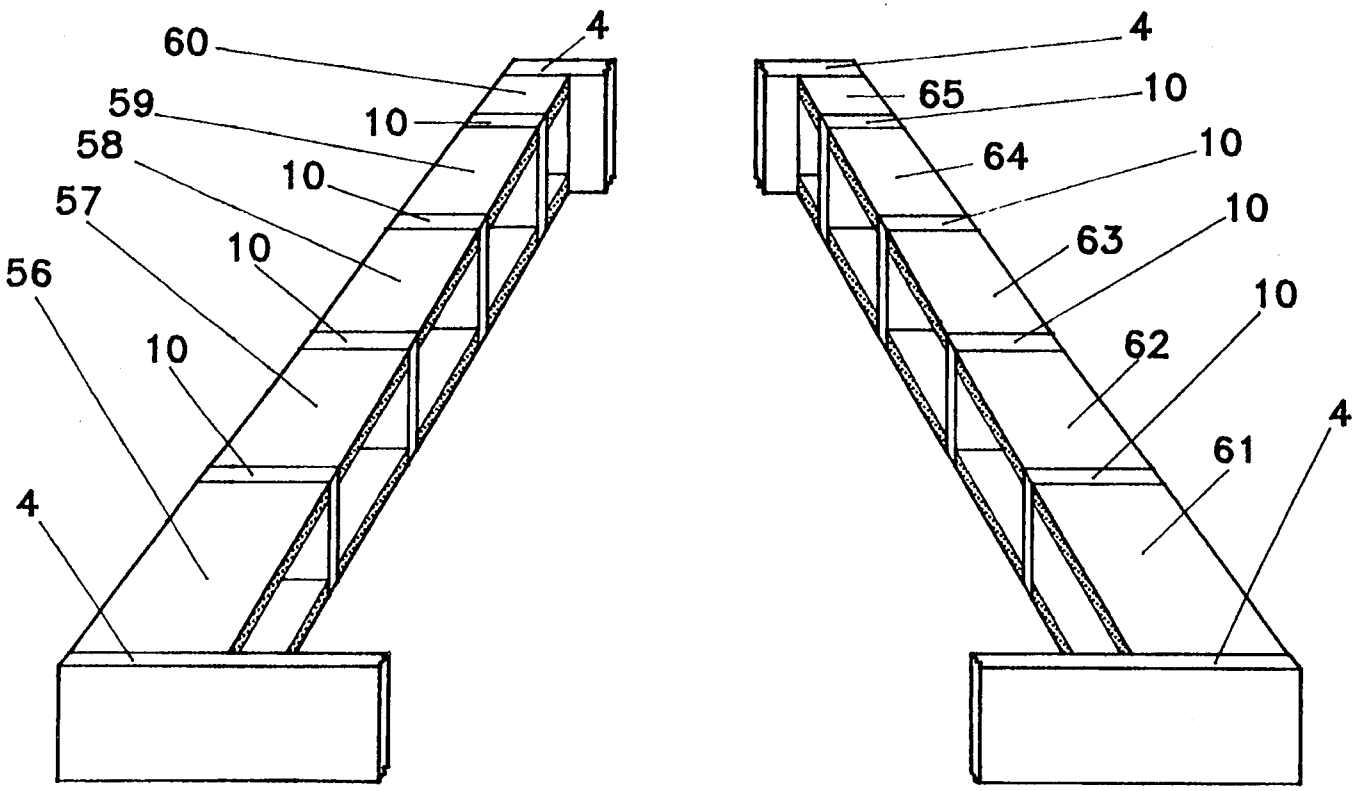
FIG. 4 is a view of the two groups of closed hollow electrodes, omitting portions of the dielectric seal, separated from the lamp.

FIG. 4 shows in detail the configuration of the resulting thick-film hollow electrodes after substrate 1 and substrate 2 are sealed together. For clarity, portion of the dielectric seal 4 which encloses the end electrodes 56, 60, 61 and 65 has been omitted. The hollow electrodes 56–60 face the hollow electrodes 61–65, and the main discharge occurs between the electrode pairs 56 and 61, 57 and 62, 58 and 63, 59 and 64, and 60 and 65, respectively. The plurality of hollow electrodes 56–60 and 61–65 are electrically isolated from each other by the plurality of isolators 10. The electrodes at the ends of each group, electrodes 56, 60, 61 and 65 are bounded on their outside edge by the dielectric seal 4. Each hollow electrode comprises upper and lower conductors printed on the rear and front substrates, respectively, illustrated as electrode conductors 21–30 and 31–40 in FIG. 2. The conductors that form closed hollow electrode 56, for example, are the conductors 31 and 21 of FIG. 2. Similarly, electrodes 57–65 are formed by conductors 22–30 and 32–40, respectively.

A substantial advantage of the described electrode arrangement is the resulting improved uniformity of brightness and longer life achieved by this lamp design. Two groups of external electrical impedances (not shown) of equal value are attached to the lead-through conductors 11–20. One group connects the conductors 11–15 depicted on the left side of FIG. 2, and the other group connects the conductors 16–20 depicted on the right side of FIG. 2. When so connected, an equal branching of electrical discharge current occurs between the corresponding electrode pairs 56 and 61, 57 and 62, 58 and 63, 59 and 64, and 60 and 65 of FIG. 4. The equal branching of electrical discharge current produces improved uniformity of brightness and extends the life of the lamp.

A further advantage of the described arrangement is that a simple and economical method of screen printing the thick-film electrodes and thick-film phosphors can be used. A still further advantage is the resulting compact flat panel structure of the lamp. This structure can be easily adopted for backlighting flat panel information display devices such as liquid crystal displays.

Figure 5:
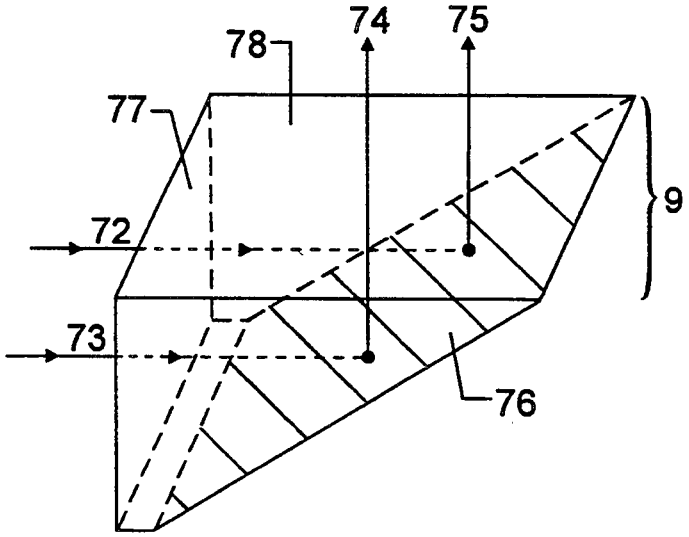
FIG. 5 is an isometric view of the right angle prism shown in FIGS. 1 and 2 and illustrates the paths of incident and reflected light rays.

FIG. 5 shows a single right angled prism 9 which is used as a light wave-guiding spacer to support the structure of lamp 100 in the central area. This structural support helps prevent the lamp 100 from imploding because of the difference between the internal and external pressures acting on each of the substrates 1 and 2. The internal pressure of the lamp is considerably lower than the external atmospheric pressure as is described above. The balance of these forces would tend to collapse the substrate inward, i.e., implosion. The right angle prism 9 adds the structural support necessary to help prevent this implosion. Although only one prism is shown, a plurality of prisms could be employed to permit the usage of thinner substrates in flat fluorescent lamps with greater surface area.

The right angle prism shown in FIG. 5 is oriented on substrate 2 with the hypotenuse-side (illustrated by the hatched area) face up (as is illustrated in FIG. 2). The light rays 72 and 73 entering face 77 and striking the hypotenuse face 76 of the prism will emerge as reflected rays 74 and 75 from face 78 and thereby from substrate 2 to which face 78 is attached. No phosphor coating exists between the prism 9 and substrate 2. In a preferred embodiment, the face 77 of the prism, where the incident rays 72 and 73 enter, is phosphor coated. In addition, the orientation of right angle prism 9 on substrate 2, in a preferred embodiment, will be oriented such that the hypotenuse face is substantially parallel to the direction of electrical discharge between the two groups of electrodes.

The right angle prism may be made of a variety of materials including soft glass or quartz glass. In addition, the reflective coating on the hypotenuse face of the prism may be an internal or external reflective coating. It should be recognized that a variety of light wave-guiding spacers may be used, and that a right angle prism is not the only configuration which may operate in this manner. For example, a fiber optic wave-guiding spacer may be used.

Figure 6:
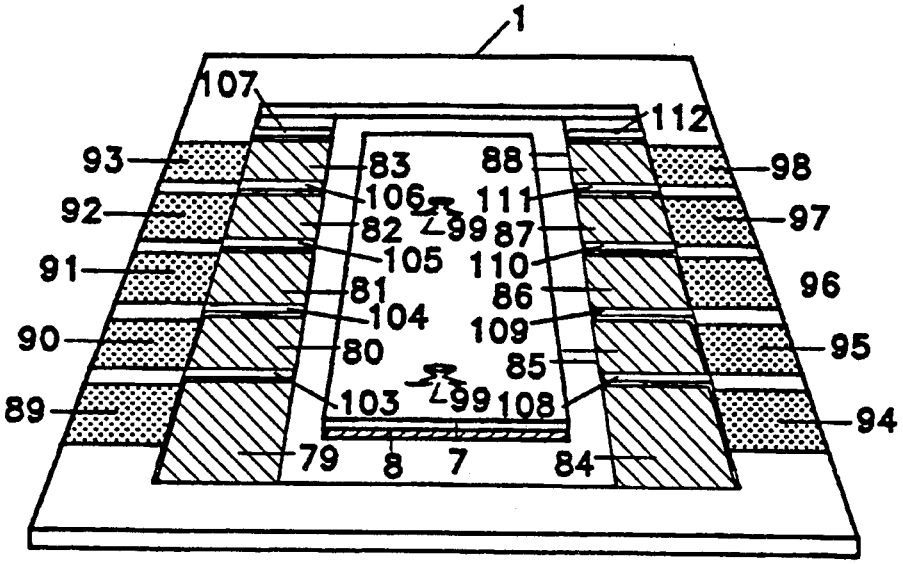
FIG. 6 is a view of the internal side of the alternative embodiment etched non-viewing substrate with integral spacers.

FIG. 6 shows an alternative embodiment of the rear substrate 1. In this embodiment, the rear substrate is selectively etched to form self-supporting integral spacers 99 and spacer ribs 103–112. Thick-film nickel conductors 79–88 are laid in the etch pits and are electrically connected to external silver lead-through conductors 89–98 disposed at a higher level than the nickel electrode conductors 79–88.

Figure 7:
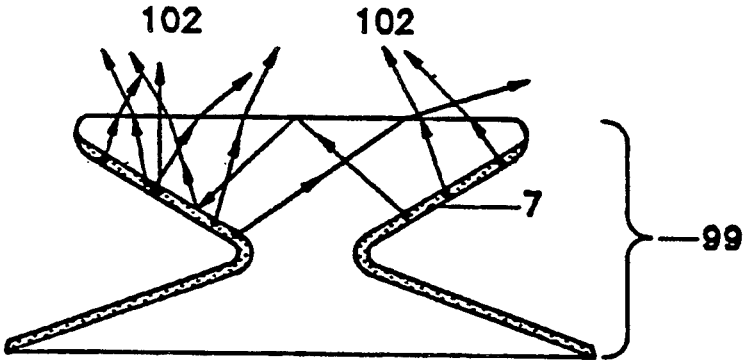
FIG. 7 is a cross-sectional view of an integral spacer with the directions of incident light rays and emerging light rays.

FIG. 7 shows the details of a self-supporting integral spacer 99. The sides of spacer 99 are coated with phosphor 7. Ultra-violet light rays entering the spacer 99 are converted to visible light rays which emerge from the top surface of the spacer as light rays 102.

A prototype of a lamp according to the present invention has been constructed. This lamp employed thick-film closed hollow electrodes with dimensions of 5 mm by 15 mm fabricated with a vertical gap of approximately 1 mm. The horizontal distance between electrodes of each group was 95 mm. The phosphor coated control illumination area was 85 mm by 100 mm, and the diagonal of the lamp 100 measured approximately 130 mm.

It will be understood that one skilled in the art could modify the above dimensions, and thus that the above description of the present invention covers such modifications, changes and adaptations. By way of example, while the presently preferred embodiment calls for screen printing of thick-film lead-through conductors 11–20 and 41–50 out of silver paste and 21–40 out of nickel, combinations of conductive paste may be used in a single layer or multilayer construction as desired. To further increase efficiency, a layer of low-work function material such as barium oxide may be coated on the inside surface of thick-film hollow electrodes.

Further, the phosphor coating on the substrate may be substituted with a thin ultra-violet layer which is transmissive in the visible wavelength light spectrum.

An alternative embodiment of the invention may replace the closed hollow electrodes with directly or indirectly heated barium strontium and calcium oxide type cathodes or barium oxide dispenser type cathodes.

In addition, an alternative embodiment of the invention may replace the inert gas and mercury vapor and phosphor coating with a gas and substrate coating suitable to produce an improved planar ultra-violet lamp to be used in photolithography or other general applications.

We claim:

1. An improved electrode structure for a flat fluorescent lamp, comprising:

a first plurality of N thick-film conductors arranged in two groups of N/2 first substrate conductors arranged one group on each edge of a first substrate;

a second plurality of N thick-film conductors arranged in two groups of N/2 second substrate conductors arranged one group on each edge of a second substrate;

said two groups of N/2 first substrate conductors and said two groups of N/2 second substrate conductors being located on their respective substrates so as to be substantially in alignment with respect to each other;

a plurality of dielectric isolators, each dielectric isolator being disposed between adjacent conductors in each group of the aligned conductors to form two groups of N/2 closed hollow electrically isolated electrodes; and means for externally electrically connecting each of the conductors on the first substrate with the corresponding aligned conductor on the second substrate, whereby each conductor in a group is electrically isolated from the other conductors in the same group.

2. The electrode structure of claim 1, wherein the connection means, further comprises:

a first plurality of N Thick-film lead-through conductors extending away from and electrically connected to the two groups of N/2 conductors on the first substrate; and a second plurality of N thick-film lead-through conductors extending away from the electrode structure and aligned with and electrically connected to the two groups of N/2 conductors on the second substrate, wherein each one of the first plurality of lead-through conductors are each electrically connected to the corresponding aligned lead-through conductor of the second plurality of lead-through conductors.

3. The electrode structure of claim 2, wherein the electrode conductors and the lead-through conductors are made of different materials.

4. The electrode structure of claim 1, wherein the dielectric isolators maintain a fixed separation between the first and second substrates.

5. An improved efficiency integrated flat fluorescent lamp with a central display area, comprising:

a first substrate having a phosphor layer substantially covering the central illumination area and a second substrate having an inner surface facing the first substrate;

two groups of a plurality of thick-film closed hollow electrodes located one group on each edge-of the central display area;

a plurality of dielectric isolators, each dielectric isolator being disposed between adjacent hollow electrodes in the two groups of the hollow electrodes and at each end of each group of electrodes to maintain electrical isolation of each electrode;

a dielectric coated seal forming a frame around the central display area and sealing the central display area; and a mixture of mercury vapor and inert gas sealed within the central display area.

6. The flat fluorescent lamp of claim 5, wherein the inner surface of the second substrate has a layer of reflective material beneath a layer of phosphor.

7. The flat fluorescent lamp of claim 5, further comprising:

at least one light wave-guiding spacer affixed in the central display area between the substrates whereby the spacer is oriented to minimize shadow-effect when the lamp is energized.

8. The flat fluorescent lamp of claim 7, wherein the light wave-guiding spacer is a right angle prism.

9. The flat fluorescent lamp of claim 8, wherein the right angle prism has a first face affixed to the first substrate, a hypotenuse face oriented facing away from the first substrate, and a second face, opposite the hypotenuse face, oriented perpendicular to the first and second substrates.

10. The flat fluorescent lamp of claim 9, wherein the right angle prism is affixed to the substrate in an area where phosphor is not present.

11. The flat fluorescent lamp of claim 5, wherein the dielectric isolators maintain a fixed separation between the first and second substrates.

12. The flat fluorescent lamp of claim 5, wherein the first substrate has a plurality of thick-film electrically conductive lead-throughs disposed thereon, each of said lead-through conductors extending from each of said electrodes in a direction away from the central illumination area under the dielectric seal to an unsealed portion of the substrate.

13. The flat fluorescent lamp of claim 7, wherein the light wave-guiding spacer is a self-supporting spindle-shaped structure having an exterior surface and a first end.

14. The flat fluorescent lamp of claim 13, wherein the first end of the light wave-guiding spacer is integral with the second substrate.

15. The flat fluorescent lamp of claim 13, wherein the exterior surface of the light wave-guiding spacer is phosphor coated.

16. The flat fluorescent lamp of claim 12, further comprising:

two groups of external electrical impedances of equal value, each of said impedances is attached to a corresponding conductor of the two groups of lead-through conductors to cause equal branching of electrical discharge current among the electrodes in the lamp.

17. The flat fluorescent lamp of claim 5, wherein the electrodes are a directly or indirectly heated barium, strontium and calcium oxide type cathodes or barium oxide dispenser type cathodes.

18. The flat fluorescent lamp of claim 6, wherein the reflective layer has a reflectance greater than 90% in the visible light range, and is reflective in the ultra-violet light spectrum.

19. The flat fluorescent lamp of claim 6, wherein the reflectance layer is made of a thick-film or a thin-film multi-layer.

20. The flat fluorescent lamp of claim 19, wherein the thin-film reflectance multi-layer is composed of titanium dioxide and silicon dioxide layers.

21. The flat fluorescent lamp of claim 19, wherein the thin-film reflectance multi-layer is composed of zirconium dioxide and silicon dioxide layers.

22. The flat fluorescent lamp of claim 19, wherein the thin-film reflectance multi-layer is composed of hafnium dioxide and silicon dioxide layers.

23. The flat fluorescent lamp of claim 7, wherein the light wave-guiding spacer is a fiber-optic wave-guiding spacer.

24. The flat fluorescent lamp of claim 8, wherein the right angle prism is made of soft glass or quartz glass.

25. The flat fluorescent lamp of claim 8, wherein the hypotenuse face of the right angle prism has an internal or external reflective coating.

26. The flat fluorescent lamp of claim 5, wherein the dielectric spacer may be formed integral with either of said first or second substrates.

27. The flat fluorescent lamp of claim 5, wherein the first substrate has a thin ultra-violet reflective layer transmissive in the visible wavelength.

28. The flat fluorescent lamp of claim 5, wherein a suitable gas and substrate coating is employed to produce a planar ultra-violet lamp.

* * * * *